US011393444B2

(12) United States Patent
Yamada

(10) Patent No.: US 11,393,444 B2
(45) Date of Patent: Jul. 19, 2022

(54) NOISE SUPPRESSOR FOR A VEHICLE AND NOISE SUPPRESSING METHOD FOR A VEHICLE

(71) Applicant: TOYOTA JIDOSHA KABUSHIKI KAISHA, Aichi-ken (JP)

(72) Inventor: Tamami Yamada, Toyota (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 17/072,034

(22) Filed: Oct. 16, 2020

(65) Prior Publication Data

US 2021/0142816 A1 May 13, 2021

(30) Foreign Application Priority Data

Nov. 12, 2019 (JP) ..... JP2019-204886

(51) Int. Cl.

| | |
|---|---|
| ***G10K 11/178*** | (2006.01) |
| ***H04R 3/00*** | (2006.01) |
| ***G10L 21/0264*** | (2013.01) |
| ***G10L 21/0316*** | (2013.01) |

(52) U.S. Cl.

CPC .. *G10K 11/17825* (2018.01); *G10K 11/17837* (2018.01); *H04R 3/005* (2013.01)

(58) Field of Classification Search

CPC ..... G10K 11/17823; G10K 11/178; G10K 11/1781; G10K 11/17821; G10K 11/175; G10K 11/178517; G10L 21/02; G10L 21/0208; G10L 21/0216; G10L 15/20; G10L 15/02; B60R 11/02; H04R 3/005; H04M 9/082; B60Q 5/005; B60Q 5/008

USPC ..... 704/226, 225, 211, 214, 215, 205, 206, 704/208, 202, 227, 228, 233; 381/71.1–71.14, 86; 700/94

See application file for complete search history.

(56) References Cited

U.S. PATENT DOCUMENTS

| | | | | |
|---|---|---|---|---|
| 5,434,783 | A * | 7/1995 | Pal | G10K 11/17873 701/36 |
| 7,062,049 | B1 | 6/2006 | Inoue et al. | |
| 2006/0188107 | A1 | 8/2006 | Inoue et al. | |
| 2008/0031468 | A1* | 2/2008 | Christoph | G10K 11/17833 381/71.2 |
| 2013/0196715 | A1* | 8/2013 | Hansson | G10L 21/0208 455/563 |
| 2016/0029111 | A1* | 1/2016 | Wacquant | H04R 3/005 381/71.4 |

(Continued)

FOREIGN PATENT DOCUMENTS

| | | | |
|---|---|---|---|
| JP | H56186 | A | 1/1993 |
| JP | H6202672 | A | 7/1994 |
| JP | H7234688 | A | 9/1995 |

(Continued)

*Primary Examiner* — Leshui Zhang

(74) *Attorney, Agent, or Firm* — Hauptman Ham, LLP

(57) ABSTRACT

A noise suppressor includes a memory; and a processor coupled to the memory, the processor is configured to: acquire a noise signal in a vicinity of a head region of an occupant seated in a vehicle seat; generate a control sound having an opposite phase to the acquired noise signal; acquire a sound signal having a predetermined frequency that is different from the noise signal; and output, as an output sound signal, the acquired sound signal in combination with the generated control sound.

8 Claims, 7 Drawing Sheets

(56) References Cited

U.S. PATENT DOCUMENTS

2019/0116421 A1 4/2019 Kano

FOREIGN PATENT DOCUMENTS

| | | | | | |
|---|---|---|---|---|---|
| JP | H8101692 | A | | 4/1996 | |
| JP | H990962 | A | | 4/1997 | |
| JP | 2000280831 | A | | 10/2000 | |
| JP | 2014174349 | A | * | 9/2014 | ..... G10K 11/178 |
| JP | 201974613 | A | | 5/2019 | |

* cited by examiner

NOISE SUPPRESSOR FOR A VEHICLE AND NOISE SUPPRESSING METHOD FOR A VEHICLE

CROSS-REFERENCE TO RELATED APPLICATION

This application claims priority under 35 USC 119 from Japanese Patent Application No. 2019-204886, filed on Nov. 12, 2019, the disclosure of which is incorporated by reference herein.

BACKGROUND

Technical Field

The present disclosure relates to a noise suppressor for a vehicle and a noise suppressing method for a vehicle.

Related Art

Japanese Patent Application Laid-Open (JP-A) No. 2019-74613 discloses a noise control device that reduces noise near the head of an occupant seated on a seat. This noise control device is configured to generate a control signal for silencing noise based on the acquired noise signal and output the control signal from the speaker.

However, in the noise control device described in Japanese Patent Application Laid-Open (JP-A) No. 2019-74613, sounds other than noise such as voices during conversation between passengers may be acquired as a noise signal.

SUMMARY

The present disclosure provides a noise suppressor for a vehicle and a noise suppressing method for a vehicle that allow a passenger to hear sounds other than noise while suppressing noise.

A first aspect of the present disclosure is a noise suppressor for a vehicle, a noise signal in a vicinity of a head region of an occupant that is seated in a seat of a vehicle is acquired by a first sound signal acquisition unit. A control sound generating unit generates a control sound having an opposite phase to the noise signal acquired by the first sound signal acquisition unit. A second sound signal acquisition unit acquires a sound signal having a predetermined frequency that is different from the noise signal. An output unit outputs the sound signal acquired by the second sound signal acquisition unit in combination with the control sound generated by the generating unit.

In the first aspect of the present disclosure, the first sound signal acquisition unit acquires a noise signal in a vicinity of a head region of an occupant that is seated in a seat of a vehicle. Further, the control sound generating unit generates a control sound having an opposite phase to the noise signal acquired by the first sound signal acquisition unit. As a result, by outputting a control sound, noise in a vicinity of a head region of an occupant can be suppressed. On the other hand, the second sound signal acquisition unit acquires a sound signal of a predetermined frequency that is different from the noise signal acquired by the first sound signal acquisition unit. In this manner, by acquiring different sounds at the first sound signal acquisition unit and the second sound signal acquisition unit, it is possible to efficiently acquire sounds other than noise.

Further, the output unit outputs the sound signal acquired by the second sound signal acquisition unit in combination with the control sound generated by the generating unit. As a result, the noise acquired by the first sound signal acquisition unit is suppressed, while the sound signal acquired by the second sound signal acquisition unit is not suppressed.

A second aspect of the present disclosure, in the first aspect, the sound signal acquired by the second sound signal acquisition unit includes at least one of a voice uttered by the occupant or a siren of an emergency vehicle.

In the second aspect of the present disclosure, the sound signal acquired by the second sound signal acquisition unit includes at least one of at least one of a voice uttered by the occupant or a siren of an emergency vehicle. As a result, at least one of a voice uttered by the occupant or a siren of an emergency vehicle can be heard by the occupant without being suppressed.

A third aspect of the present disclosure, in the first aspect or the second aspect, the noise signal acquired by the first sound signal acquisition unit includes at least one of road noise, wind noise, or an air blowing sound of an air conditioner.

In the third aspect of the present disclosure, the first sound signal acquisition unit acquires, as a noise signal, at least one sound of road noise, wind noise, or an air blowing sound. As a result, a control sound having an opposite phase to at least one sound of road noise, wind noise, or an air blowing noise is generated at the control sound generating unit.

A fourth aspect of the present disclosure, in any one of the first aspect to the third aspect, the sound signal output at the output unit is acquired by an output sound signal acquisition unit. In a case in which the sound signal acquired by the output sound signal acquisition unit is larger than the noise signal acquired by the first sound signal acquisition unit, the output unit stops output of the control sound.

In the fourth aspect of the present disclosure, the sound signal output at the output unit is acquired by the output sound signal acquisition unit. Further, in a case in which the sound signal acquired by the output sound signal acquisition unit is larger than the noise signal acquired by the first sound signal acquisition unit, the output of the control sound by the output unit is stopped. As a result, in the unlikely event that noise suppressing is not performed correctly, the output of a sound that is larger than the noise signal is suppressed.

A fifth aspect of the present disclosure, in any one of the first aspect to the fourth aspect, the first sound signal acquisition unit acquires noise signals from respective first microphones that are provided in a vicinity of each seat in the vehicle which is equipped with plural seats. Further, the control sound generating unit generates respective control sounds for each seat, and the second sound signal acquisition unit acquires sound signals from respective second microphones that are in a vicinity of each seat. Further, from respective speakers provided in a vicinity of each seat, the output unit outputs a control sound corresponding to the seat and outputs a sound signal acquired at the second microphone of the seat.

In the fifth aspect of the present disclosure, noise signals are acquired by respective first microphones for each seat of the vehicle, and a control sound having an opposite phase to the noise signals is generated. As a result, in a vehicle having plural seats, noise can be suppressed for each seat. Further, the output unit acquires sound signals by respective second microphones for each seat and outputs the sound signals acquired at the second microphone of the seat. As a result, a conversation between occupants is not disturbed.

A sixth aspect of the present disclosure, in the fifth aspect, at least one of a vehicle accelerator position or a vehicle acceleration is detected by a vehicle information detection unit. The output unit reduces an amplitude of at least one control sound to be output as an increase is indicated by at least one of accelerator position or the acceleration detected by the vehicle information detection unit.

In the sixth aspect of the present disclosure, the output unit reduces the amplitude of at least one control sound to be output as at least one of the accelerator position or the acceleration increases. As a result, the level of noise that is suppressed by the control sound is reduced. That is, the noise suppression level decreases as at least one of the accelerator position or the acceleration increases. As a result, it is possible to give an occupant a feeling of speeding while the vehicle is accelerating.

A seventh aspect of the present disclosure, in the fifth or sixth aspect, an alertness level of the occupant is detected by an alertness level sensor. Further, in a case in which the alertness level detected by the alertness level sensor is lower than a predetermined value, the output unit reduces an amplitude of at least one control sound to be output.

In the seventh aspect of the present disclosure, an amplitude of at least one control sound to be output is reduced in a case in which the alertness level of the occupant is lower than the predetermined value. As a result, the level of noise that is suppressed by the control sound is reduced, and an occupant with a low alertness level, such as when falling asleep, can hear the noise signal.

An eighth aspect of the present disclosure, in any one of the first aspect to the seventh aspect, a predicting unit inputs the noise signal acquired by the first sound signal acquisition unit into a learned model in which a noise signal during traveling is generated as learning data [generated as learning data of the noise signal during traveling?]. As a result, the predicting unit predicts the noise signal after a predetermined amount of time has passed. The control sound generating unit generates a control sound having an opposite phase to the noise signal after a predetermined amount of time has passed, which has been predicted by the predicting unit.

In the eighth aspect of the present disclosure, the predicting unit predicts the noise signal after a predetermined time has passed by inputting the noise signal acquired by the first sound signal acquisition unit into the learned model. Then, the control sound generating unit generates a control sound having an opposite phase to the noise signal after a predetermined amount of time has passed, which has been predicted by the predicting unit. As a result, the control sound can be generated in consideration of the time from the acquisition of the noise signal by the first sound signal acquisition unit to the generation and output of the control sound.

A ninth aspect of the present disclosure is a noise suppressing method for a vehicle, acquires a noise signal in a vicinity of a head region of an occupant that is seated in a seat of a vehicle in a first sound signal acquisition step. In a control sound generating step, a control sound having an opposite phase to the noise signal acquired in the first sound signal acquisition unit is generated. In a second sound signal acquisition step, a sound signal having a predetermined frequency that is different from the noise signal is acquired. In an output step, the sound signal acquired in the second sound acquisition step is output in combination with the control sound generated in the control sound generating step.

In the ninth aspect of the present disclosure, a noise signal in a vicinity of a head region of an occupant that is seated in a seat of a vehicle is acquired in the first sound signal acquisition step. In the control sound generating step, a control sound having an opposite phase to the noise signal acquired in the first sound signal acquisition step is generated. In the second sound signal acquisition step, a sound signal having a predetermined frequency that is different from the noise signal acquired in the first sound signal acquisition step is acquired. In the output step, the sound signal acquired in the second sound signal acquisition step is outputted in combination with the control sound generated in the control sound generating step. As a result, noise acquired in the first sound signal acquisition step is suppressed, while the sound signal acquired in the second sound signal acquisition step is not suppressed.

According to the first aspect of the present disclosure, while suppressing noise, an occupant can hear sounds other than noise.

According to the second aspect of the present disclosure, it is possible to suppress noise while preventing sounds such as voices and a siren of an emergency vehicle from being suppressed.

According to the third aspect of the present disclosure, noise such as road noise, wind noise, and air blowing noise can be suppressed.

According to the fourth aspect of the present disclosure, the comfort of an occupant can be favorably maintained.

According to the fifth aspect of the present disclosure, the comfort in a vehicle interior can be further improved.

According to the sixth aspect of the present disclosure, it is possible to prevent the pleasure of driving a vehicle from being impaired.

According to the seventh aspect of the present disclosure, an occupant can be awakened from sleepiness.

According to the eighth aspect of the present disclosure, it is possible to suppress noise more effectively as compared with a case in which the control sound is made to have the opposite phase to the obtained noise signal.

According to the ninth aspect of the present disclosure, it is possible to suppress noise while an occupant can hear sounds other than noise.

BRIEF DESCRIPTION OF THE DRAWINGS

Exemplary embodiments will be described in detail based on the following figures, wherein.

DETAILED DESCRIPTION

First Exemplary Embodiment

The noise suppressor 10 according to the first embodiment will be described with reference to the drawings. In the present embodiment, as an example, a configuration in which the noise suppressor 10 is applied to a vehicle will be described.

The noise suppressor 10 according to the present embodiment suppresses noise in the vehicle compartment based on the principle of active noise control. That is, the sound having the opposite phase to the noise in the vehicle interior is generated and output, so that the phase cancellation is utilized to muffle the detected noise.

Hardware Configuration of Noise Suppressor 10

Figure 1:
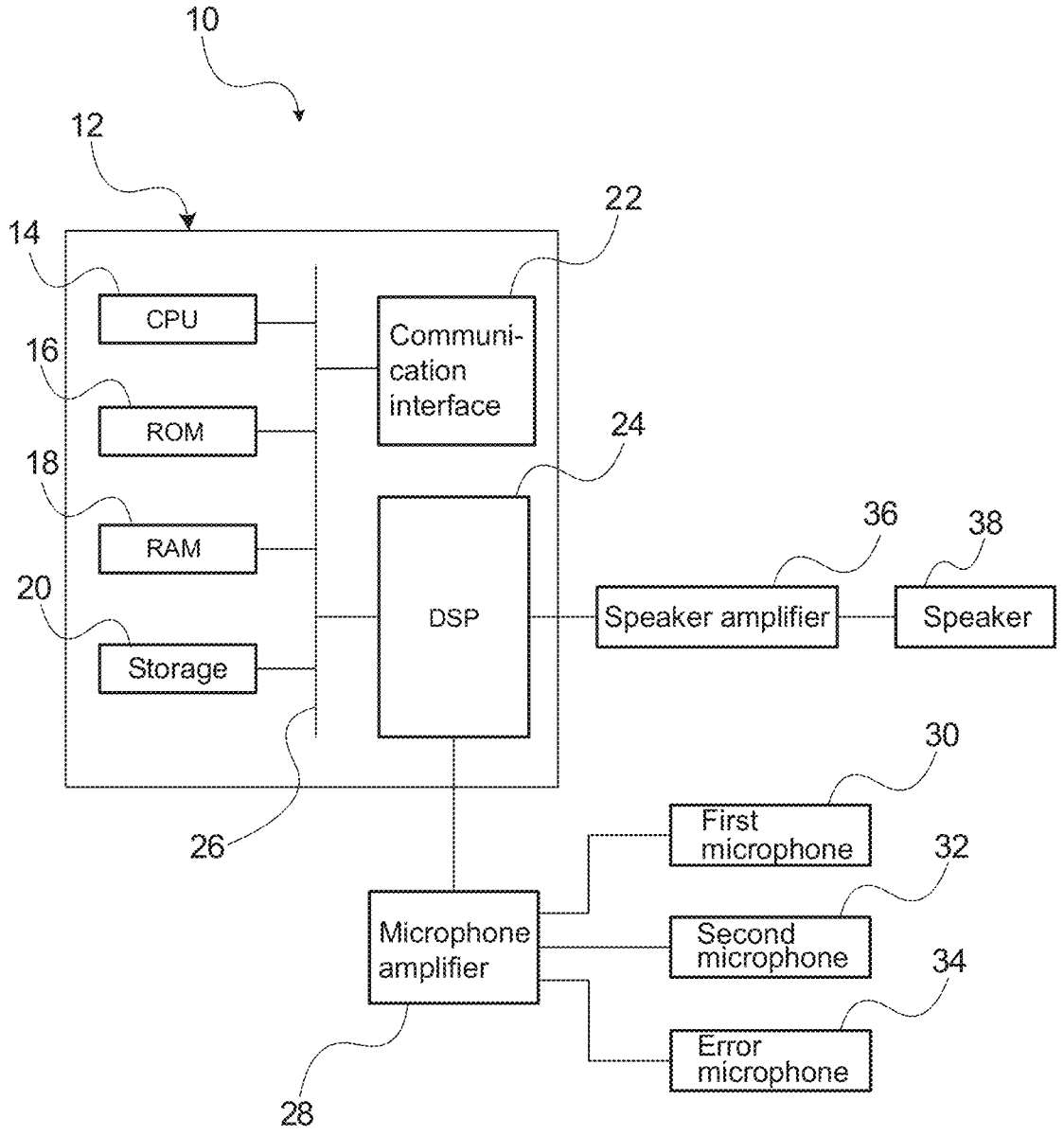
FIG. 1 is a block diagram illustrating a hardware configuration of a noise suppressor according to a first embodiment.

FIG. 1 is a block diagram illustrating a hardware configuration of the noise suppressor 10. As illustrated in FIG. 1, the control unit 12 of the noise suppressor 10 includes a CPU (Central Processing Unit) 14, a ROM (Read Only Memory) 16, a RAM (Random Access Memory) 18, a storage 20, a communication interface 22, and a DSP (Digital Signal Processor) 24. Each of these components is connected together so as to be configured for mutual communication via a bus 26. The CPU 14 is an example of a processor. At least one of the RAM 18, the ROM 16 or the storage 20 is an example of a memory.

The CPU 14 is a central computation processing unit that executes various programs and controls the respective sections. Namely, the CPU 14 reads out a program from the ROM 16 or the storage 20, and executes the program by using the RAM 18 as a work space. The CPU 14 controls each of the components and performs various computation processing according to the program recorded in the ROM 16 or the storage 20.

The ROM 16 stores various programs and various data. The RAM 18 acts as a workspace for temporary storage of programs and data. The storage 20 is structured by an HDD (Hard Disk Drive) or an SSD (Solid State Drive), and various types of programs including the operating system, and various types of data are stored therein. In the present embodiment, the ROM 16 or the storage 20 stores a program for performing noise muffling processing, a learned model M (see FIG. 3), and the like.

The communication interface 22 is an interface which the noise suppressor 10 uses to communicate with a server and other devices (not illustrated), and, for example, employs a protocol such as Ethernet, LTE, FDDI, or Wi-Fi.

A microphone amplifier 28 and a speaker amplifier 36 are connected to the DSP 24, and a first microphone 30, a second microphone 32, and an error microphone 34 are connected to the microphone amplifier 28. The first microphone 30 is provided, for example, at a height near the head of the occupant in each seat of the vehicle, and acquires a noise signal near the head of the occupant seated in the seat. Therefore, the first microphone 30 may be configured such that its height is adjusted manually or automatically according to the seat height of the occupant sitting in the seat.

The second microphone 32 is provided, for example, at the height of the face of the occupant in each seat of the vehicle, and acquires the voice when the occupant speaks. Therefore, the second microphone 32 may be configured such that its height is adjusted manually or automatically according to the seat height of the occupant sitting in the seat.

The error microphone 34 acquires an error signal after the noise muffling at each seat. By feeding back the error signal obtained by the error microphone 34 to the DSP 24, the noise can be muted more effectively. It should be noted that in the present embodiment, the mute control is performed using the LMS algorithm in a known method. For example, the methods described in Japanese Patent Application (JP-A) No. 2000-280831 and Japanese Patent Application (JP-A) No. H8-194489 can be adopted.

On the other hand, a speaker 38 is connected to the speaker amplifier 36. The speaker 38 is provided in each seat of the vehicle and outputs a sound signal to each seat. Although only one each of the first microphone 30, the second microphone 32, the error microphone 34, and the speaker 38 is illustrated in FIG. 1, the actual number of each of these provided corresponds to the number of seats.

Functional Configuration of the Noise Suppressor 10

The noise suppressor 10 implements various functions by using the above hardware resources. The functional configuration that is realized by the noise suppressor 10 is explained with reference to FIG. 2.

Figure 2:
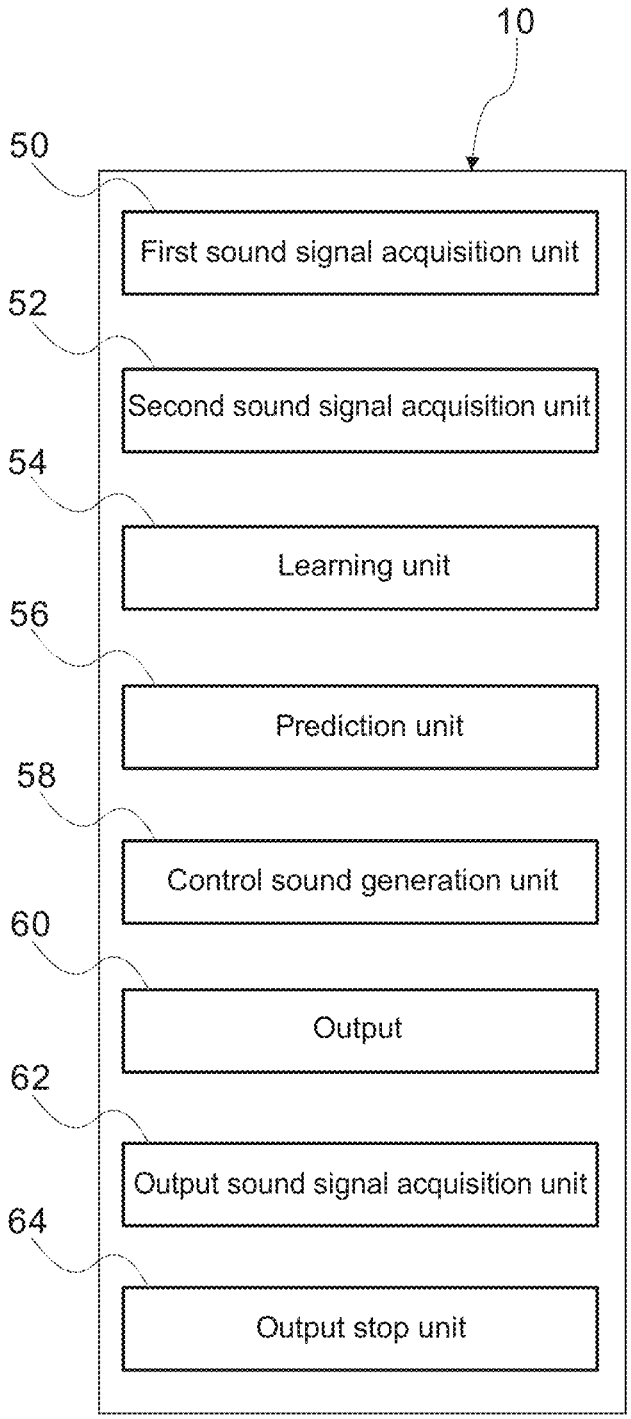
FIG. 2 is a block diagram illustrating a functional configuration of the noise suppressor according to the first embodiment.

As illustrated in FIG. 2, the noise suppressor 10 has a functional configuration including a first sound signal acquisition unit 50, a second sound signal acquisition unit 52, a learning unit 54, a prediction unit 56, a control sound generation unit 58, an output 60, an output sound signal acquisition unit 62, and an output stop unit 64. These respective functional structures are realized by the CPU 14 reading out and executing programs that are recorded in the ROM 16 or the storage 20.

The first sound signal acquisition unit 50 acquires a noise signal in the vicinity of the head of an occupant seated in a seat. Specifically, the first sound signal acquisition unit 50 acquires a noise signal by filtering after the sound near the head of the occupant is collected by the first microphone 30 provided in each seat. Note that the noise signal here is a signal including at least one of road noise, wind noise, and air blowing noise of the air conditioner, and in the present embodiment, all of the road noise, wind noise, and air blowing noise are acquired as noise signals.

The second sound signal acquisition unit 52 acquires a sound signal having a predetermined frequency different from the noise signal. Specifically, the second sound signal acquisition unit 52 acquires a sound signal with a predetermined frequency by filtering after the sound at a height of the face of the occupant is collected by the second microphone 32 provided in each seat. The sound signal of the predetermined frequency here is a sound signal of a frequency including at least one of the voice uttered by the occupant and the siren of the emergency vehicle, and in the present embodiment, the sound signal of the frequency of both the voice and the siren are acquired.

Figure 3:
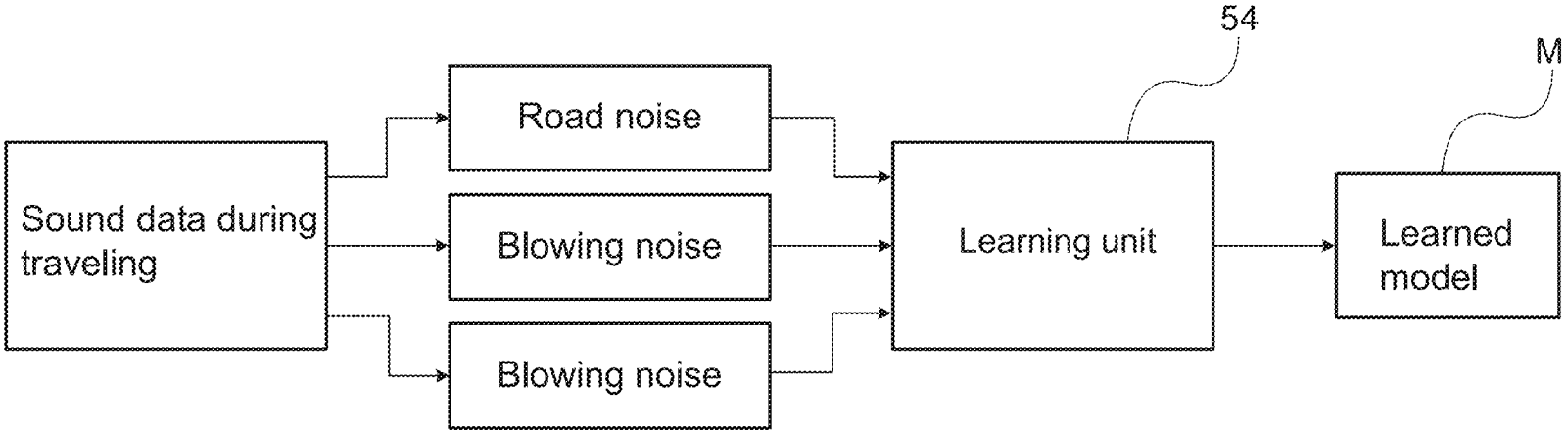
FIG. 3 is a block diagram for explaining the learning phase in the first embodiment.

As illustrated in FIG. 3, the learning unit 54 generates a learned model M by performing machine learning using typical road surface traveling data. Specifically, by obtaining road noise, wind noise, and blowing noise from the sound data during traveling, and performing machine learning in the learning unit 54 using the road noise, wind noise, and blowing noise as teacher data, a learned model M is generated. As the learned model M, for example, a deep neural network is applied. As an example of the learned model M of the present embodiment, an LSTM (Long Short Term Memory), which is a type of RNN (Recursive Neural Network), is applied.

In addition, the learning unit 54 has a function of updating the learned model M by learning from the sound data during actual traveling in the operation phase using the learned model M. The timing of updating the learned model M is performed when the CPU 14 performance has leeway. For example, it is performed when the vehicle is stopped or parked. Furthermore, the updated learned model M may be transmitted to an external server or the like via the communication interface 22.

As illustrated in FIG. 2, the prediction unit 56 inputs the noise signal acquired by the first sound signal acquisition unit 50 to the learned model M generated by the learning unit 54, and thus predicts a noise signal after a predetermined amount of time elapses. Here, the sampling frequency is required to have a score that is enough to understand the waveform of the maximum frequency, and it is possible to predict up to a high frequency by finely setting the sampling. On the other hand, when the sampling is set finely, the load on the COU 14 becomes large, so that the optimum sampling frequency is determined according to the performance of the CPU 14.

The control sound generation unit 58 generates a control sound having the opposite phase to the noise signal for each seat. The control sound generation unit 58 of the present embodiment generates a control sound having the opposite phase to the noise signal after the elapse of the predetermined amount of time as predicted by the prediction unit 56. Specifically, the time from when the sound is collected by the first microphone 30 to when the control sound is generated is set as the predetermined amount of time, and the noise signal after the elapse of the predetermined amount of time is predicted by the prediction unit 56. Then, the control sound generation unit 58 generates a control sound having the opposite phase to the predicted noise signal after the elapse of the predetermined amount of time.

The output unit 60 adds the sound signal acquired by the second sound signal acquisition unit 52 to the control sound generated by the control sound generation unit 58 and outputs the control sound with the added sound signal as an output sound signal. Specifically, the output unit 60 outputs the control sound corresponding to each seat from the speaker 38 provided in the vicinity of each seat, and also outputs the sound signal acquired by the second microphones 32 of all seats from the speaker 38 (that is, the voice uttered by the occupant and the siren of the emergency vehicle).

The output sound signal acquisition unit 62 acquires the output sound signal output by the output unit 60. Specifically, the output sound signal output from the speaker 38 is acquired by the error microphone 34.

The output stop unit 64 stops the output of the output sound signal by the output unit 60 when the output sound signal acquired by the output sound signal acquisition unit 62 is larger than the noise signal acquired by the first sound signal acquisition unit 50. That is, when the sound output by the output unit 60 becomes louder than the sound collected by the first microphone 30, it is determined that the noise muffling is not performing well, and the output of the output sound signal by the output unit 60 is stopped.

Operation

Next, the operation of the present exemplary embodiment will be described.

Noise Suppressing Process

An example of the noise suppressing process for silencing the noise signal will be described with reference to the flowchart illustrated in FIG. 4. This noise suppressing processing is executed by the CPU 14 reading out a silencing program from the ROM 16 or the storage 20, outputting the program to the RAM 18, and executing it.

Figure 4:
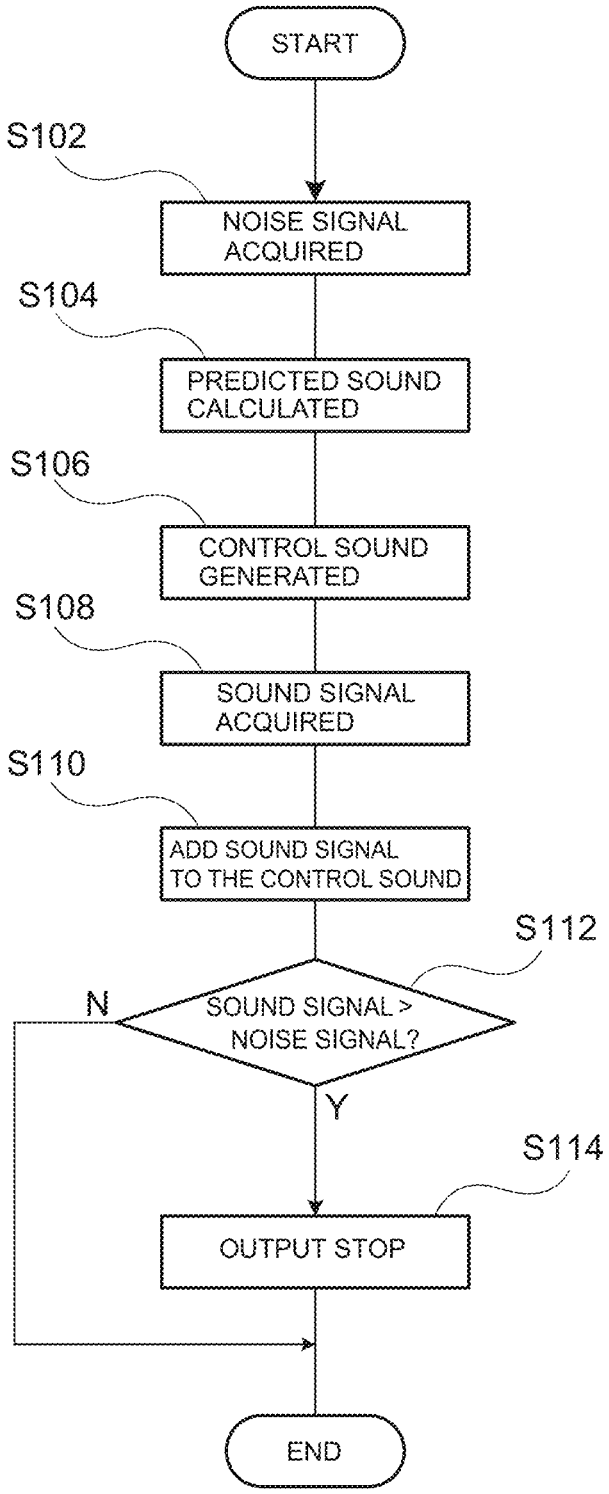
FIG. 4 is a flowchart illustrating an example of a flow of a noise suppressing process according to the first embodiment.

As illustrated in FIG. 4, the CPU 14 acquires a noise signal in step S102 (first sound signal acquisition step). Specifically, the CPU 14 collects a sound near the head of the occupant from the first microphone 30 of each seat by the function of the first sound signal acquisition unit 50, and acquires a noise signal for each seat.

Next, the CPU 14 calculates a predicted sound in step S104. Specifically, the CPU 14 predicts the noise signal after the elapse of a predetermined amount of time by the function of the prediction unit 56. The learned model M is used for the prediction of the noise signal at this time.

The CPU 14 generates a control sound in step S106. Specifically, the CPU 14 uses the function of the control sound generation unit 58 to generate a control sound having the opposite phase to the noise signal after the elapse of the predetermined amount of time as predicted by the prediction unit 56 for each seat (control sound generation step).

The CPU 14 acquires a sound signal of a predetermined frequency different from the noise signal in step S108 (second sound signal acquisition step). Specifically, the CPU 14 collects the sound at the height of the face of the occupant from the second microphone 32 provided in each seat by the function of the second sound signal acquisition unit 52, and acquires the sound signal of the predetermined frequency.

The CPU 14 adds the acquired sound signal to the control sound in step S110 and outputs it (output step). Specifically, by the function of the output unit 60, the CPU 14 adds the sound signal acquired by the second sound signal acquisition unit 52 to the control sound generated by the control sound generation unit 58 and outputs the control sound with the added sound signal as an output sound signal. Here, as described above, the output unit 60 outputs the control sound corresponding to each seat from the speaker 38 provided near each seat. Further, the output unit 60 outputs the sound signals acquired by the second microphones 32 of all seats. Thus, for example, the driver in the front seat can hear the voice uttered in the rear seat.

Subsequently, the CPU 14 determines in step S112 whether or not the sound after the phase cancellation is larger than the noise signal. Specifically, the CPU 14 uses the function of the output sound signal acquisition unit 62 to acquire the output sound signal output from the speaker 38 using the error microphone 34. Then, when the output sound signal obtained by the error microphone 34 is larger than the noise signal acquired by the first microphone 30, that is, when the amplitude of the output sound signal obtained by the error microphone 34 is larger than the amplitude of the noise signal acquired by the first microphone 30, the CPU 14 proceeds to the process of step S114. On the other hand, when the amplitude of the output sound signal acquired by the error microphone 34 is smaller than the amplitude of the noise signal acquired by the first microphone 30, the noise muffling process is ended due to the sound being normally muffed.

The CPU 14 stops the output of the control sound and the sound signal by the output unit 60 in step S114. When the amplitude of the output sound signal acquired by the error microphone 34 is larger than the amplitude of the noise signal, it means that noise muffling is not being normally performed; therefore, by stopping the output of the control sound and the sound signal, the generation of sound louder than the noise signal is suppressed.

As described above, in the present embodiment, by acquiring different sounds in the first sound signal acquisition unit 50 and the second sound signal acquisition unit 52, it is possible to efficiently acquire sounds other than noise. Further, the output unit 60 adds the sound signal acquired by the second sound signal acquisition unit 52 to the control sound generated by the control sound generation unit 58 and outputs the control sound with the added sound signal as an output sound signal. As a result, the noise acquired by the first sound signal acquisition unit 50 is suppressed, while the sound signal acquired by the second sound signal acquisition unit 52 is not silenced. That is, while suppressing the noise, the occupant can hear the sound other than the noise.

Further, in the present embodiment, the sound signal acquired by the second sound signal acquisition unit 52 includes at least one of the voice uttered by the occupant and the siren of the emergency vehicle. Accordingly, at least one of the voice uttered by the occupant and the siren of the emergency vehicle can be heard by the occupant without being muted.

Furthermore, in the present embodiment, the control sound generation unit 58 generates a control sound having an opposite phase to the sound of at least one of road noise, wind noise, and blowing noise. As a result, noise such as road noise, wind noise, and blowing noise can be silenced.

Further, in the present embodiment, the output of the output sound signal by the output unit 60 is stopped when the output sound signal acquired by the output sound signal acquisition unit 62 is larger than the noise signal acquired by the first sound signal acquisition unit 50. As a result, in the unlikely event that noise muffling is not performed correctly, it is possible to suppress the output of a sound that is louder than the noise signal, and it is possible to maintain a good passenger comfort performance.

Further, in the present embodiment, the noise signal is acquired by the first microphone 30 for each seat of the vehicle, and the control sound having the opposite phase to this noise signal is generated, so that in the vehicle having plural seats, noise can be muffled for each seat. Further, the output unit 60 acquires sound signals by the second microphone 32 for each seat and outputs the sound signals acquired by the second microphones 32 of all seats. As a result, the conversation between passengers is not disturbed, and the comfort performance in the passenger compartment can be improved.

Furthermore, in the present embodiment, the prediction unit 56 inputs the noise signal acquired by the first sound signal acquisition unit 50 into the learned model M to predict the noise signal after a predetermined amount of time has elapsed. Then, the control sound generation unit 58 generates a control sound having the opposite phase to the noise signal after the elapse of the predetermined amount of time, as predicted by the prediction unit 56. Accordingly, the control sound can be generated in consideration of the time from the acquisition of the noise signal by the first sound signal acquisition unit 50 to the generation of the control sound, and the sound can be muted more effectively compared with the case in which the opposite phase of the acquired noise signal is used as the control sound.

Second Exemplary Embodiment

Next, the noise suppressor 70 according to the second embodiment will be described with reference to the drawings. Note that features similar to the first exemplary embodiment are designated with the same reference numerals, and explanation thereof is omitted as appropriate.

Hardware Configuration of Noise Suppressor 70

Figure 5:
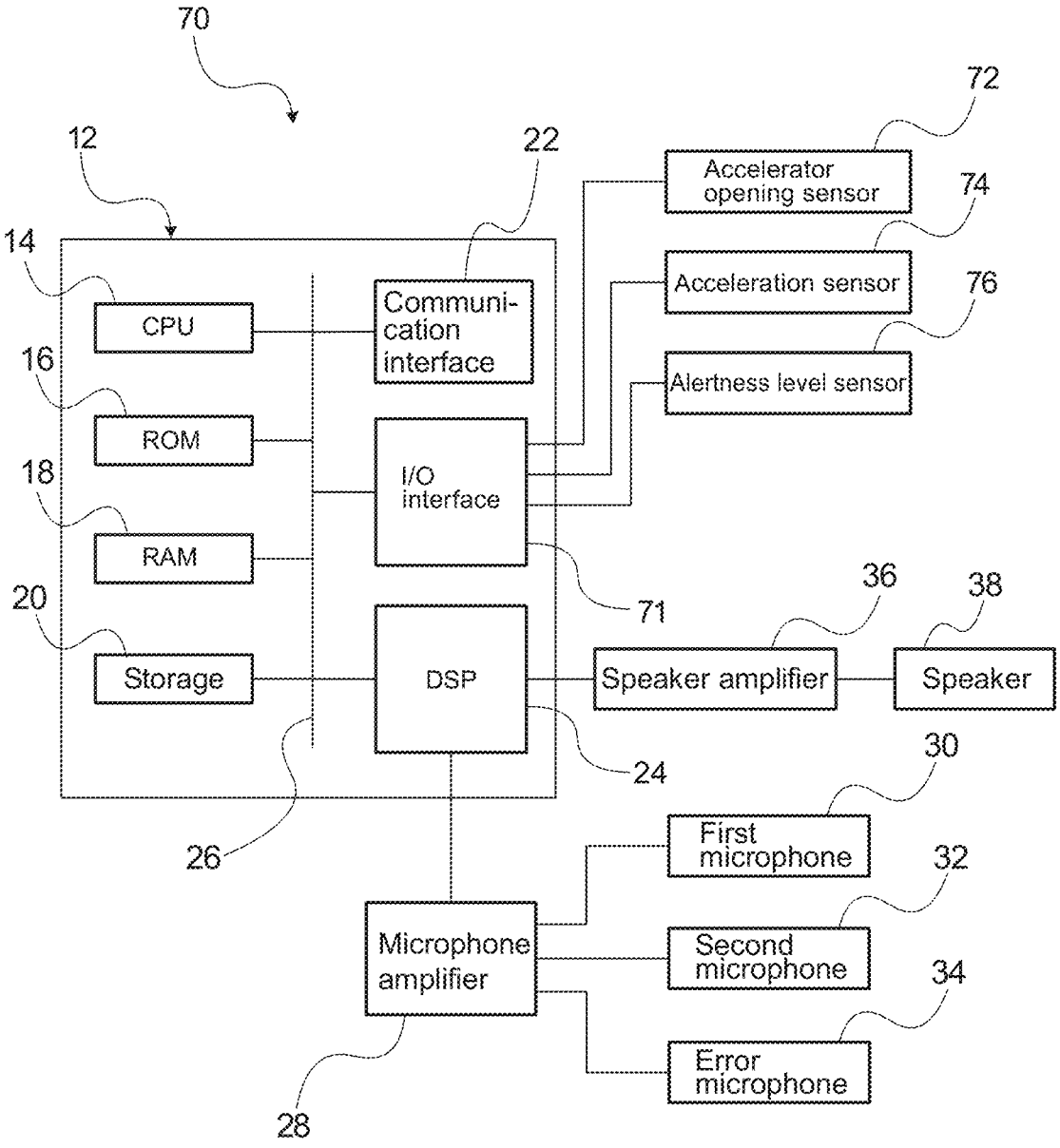
FIG. 5 is a block diagram illustrating a hardware configuration of a noise suppressor according to a second embodiment.

FIG. 5 is a block diagram illustrating a hardware configuration of a noise suppressor 70 according to the present embodiment. As illustrated in FIG. 5, the I/O interface 71 of the noise suppressor 70 is connected to an accelerator opening sensor 72, an acceleration sensor 74, and an alertness level sensor 76.

The accelerator opening sensor 72 is a sensor for detecting the accelerator opening of the vehicle, and for example, a throttle position sensor is used. The acceleration sensor 74 is a sensor for detecting the acceleration of the vehicle. Then, the accelerator opening sensor 72 and the acceleration sensor 74 correspond to an example of a vehicle information detection unit of the present disclosure.

The alertness level sensor 76 is a sensor for detecting the wakefulness or alertness level of the occupant, and for example, a camera that captures images of the eyes of the occupant is used. In addition, the alertness level may be detected from biological information such as heartbeat and brain waves. The alertness level sensor 76 is provided in each seat of the vehicle.

Functional Configuration of the Noise Suppressor 70

Figure 6:
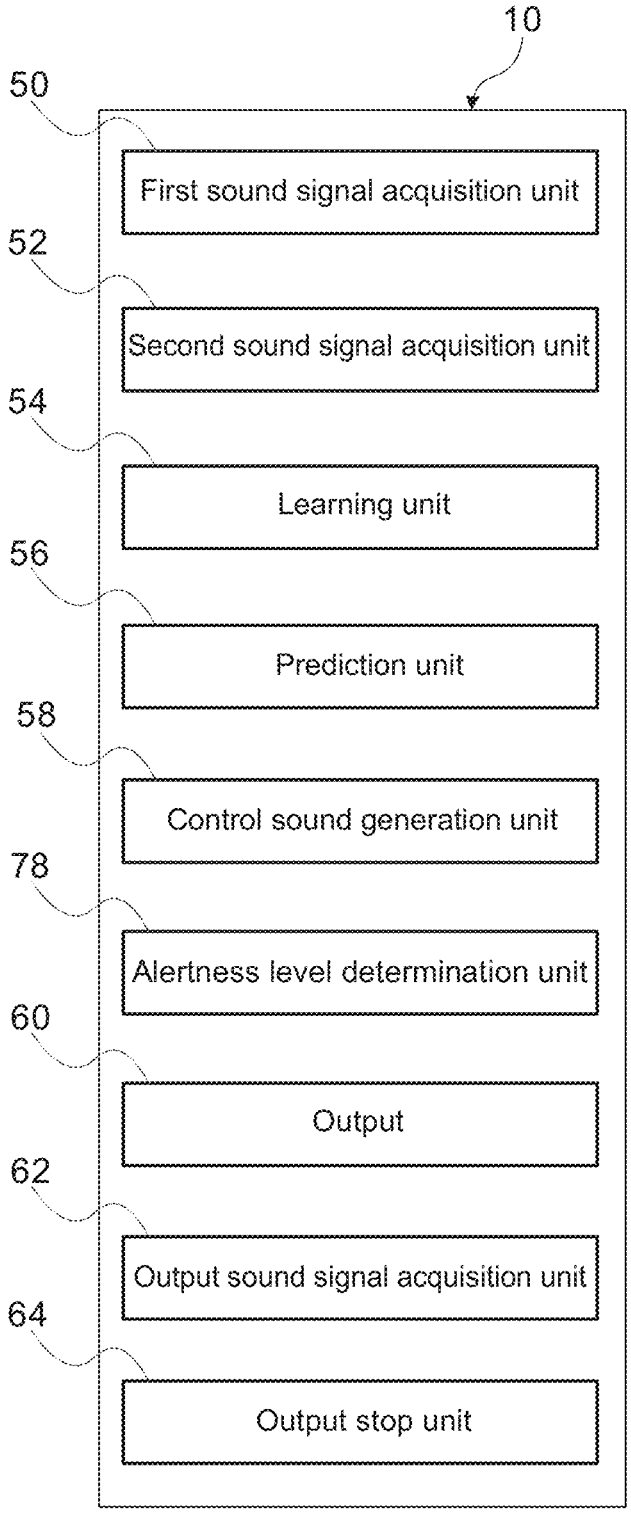
FIG. 6 is a block diagram illustrating a functional configuration of the noise suppressor according to the second embodiment.

As illustrated in FIG. 6, the noise suppressor 70 has a functional configuration including a first sound signal acquisition unit 50, a second sound signal acquisition unit 52, a learning unit 54, a prediction unit 56, a control sound generation unit 58, an alertness level determination unit 78, an output 60, an output sound signal acquisition unit 62, and an output stop unit 64.

Here, the alertness level determination unit 78 determines whether or not the awakening degree or alertness level of the occupant detected by the or alertness level sensor 76 is lower than a predetermined value. The predetermined value is set to a value at which drowsiness is generally recognized. Therefore, when the alertness level determination unit 78 determines that the awakening degree of the occupant is lower than the predetermined value, drowsiness of the occupant is recognized. The alertness level determination unit 78 determines the wakefulness or awakening degree or alertness level for each occupant seated in each seat.

Further, in the present embodiment, the output unit 60 reduces the amplitude of the control sound output under a predetermined condition. For example, the output unit 60 reduces the amplitude of the control sound to be output as the accelerator opening detected by the accelerator opening sensor 72 and the acceleration detected by the acceleration sensor 74 increase.

Further, in the present embodiment, the output unit 60 makes the amplitude of the control sound to be output smaller when the alertness level determining unit 78 determines that the awakening degree or alertness level detected by the alertness level sensor 76 is lower than the predetermined value.

As described above, when the output unit 60 reduces the amplitude of the control sound, the noise muffling level is lowered, and some noise signals are not silenced. That is, the occupant can hear the noise.

Operation

Next, the operation of the present exemplary embodiment will be described.

Noise Suppressing Process

An example of the noise suppressing process for silencing the noise signal will be described with reference to the flowchart illustrated in FIG. 7. This noise suppressing processing is executed by the CPU 14 reading out a silencing program from the ROM 16 or the storage 20, outputting the program to the RAM 18, and executing it.

Figure 7:
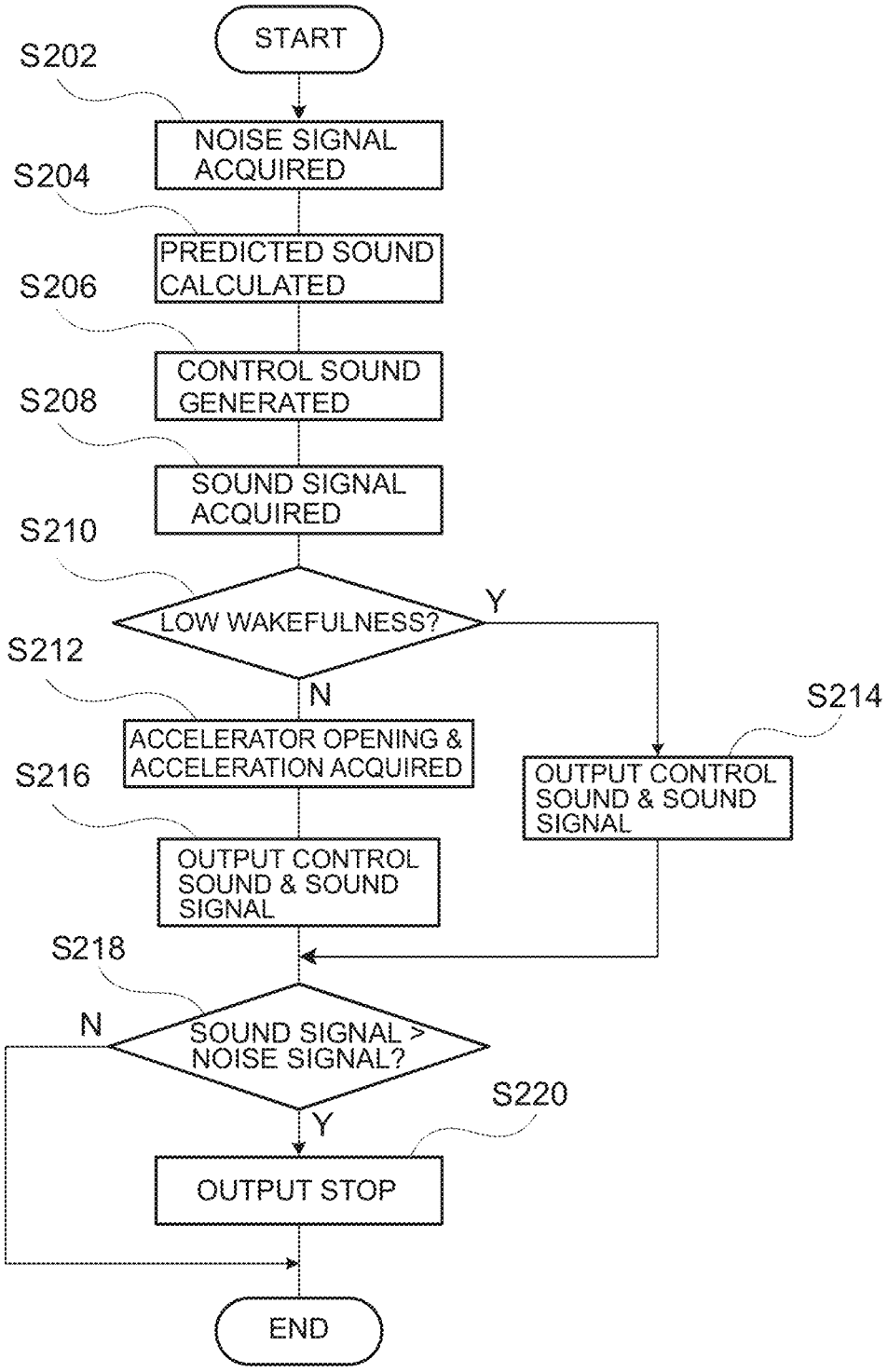
FIG. 7 is a flowchart illustrating an example of a flow of a noise suppressing process according to the second embodiment.

As illustrated in FIG. 7, the CPU 14 acquires a noise signal in step S202. Specifically, the CPU 14 collects a sound near the head of the occupant from the first microphone 30 of each seat by the function of the first sound signal acquisition unit 50, and acquires a noise signal for each seat.

Next, the CPU 14 calculates a predicted sound in step S204. Specifically, the CPU 14 predicts the noise signal after the elapse of a predetermined amount of time by the function of the prediction unit 56. The learned model M is used for the prediction of the noise signal at this time.

The CPU 14 generates a control sound in step S206. Specifically, the CPU 14 uses the function of the control sound generation unit 58 to generate a control sound having the opposite phase to the noise signal after the elapse of the predetermined amount of time, as predicted by the prediction unit 56 for each seat.

The CPU 14 acquires a sound signal of a predetermined frequency different from the noise signal in step S208. Specifically, the CPU 14 collects the sound at the height of the face of the occupant from the second microphone 32 provided in each seat by the function of the second sound signal acquisition unit 52, and acquires the sound signal of a predetermined frequency.

The CPU 14 determines in step S210 whether or not the wakefulness or alertness level of the occupant is lower than a predetermined value. Specifically, the CPU 14 determines, for each seat, whether or not the wakefulness of the occupant detected by the alertness level sensor 76 by the function of the alertness level determination unit 78 is lower than a predetermined value. Then, when it is determined that the awakening degree or wakefulness or alertness level is lower than the predetermined value in step S210, the CPU 14 proceeds to the process of step S214. On the other hand, when it is determined in step S210 that the awakening degree is equal to or higher than the predetermined value, the CPU 14 proceeds to the process of step S212. These judgments are made for each seat.

For a seat in which the awakening degree of the occupant is lower than the predetermined value, the CPU 14 outputs the control sound with a reduced amplitude and the sound signal in step S214. Specifically, by the function of the output unit 60, the CPU 14 outputs from the speaker 38 the control sound with an amplitude smaller than the amplitude of the control sound generated at step S206. Further, the output unit 60 outputs the sound signal from the speaker 38 without changing the amplitude of the sound signal. The CPU 48 then transitions to the processing of step S218.

On the other hand, the CPU 14 obtains the accelerator opening degree and the acceleration in step S212 for the seat in which the awakening degree of the occupant is the predetermined value or more. Specifically, the CPU 14 acquires the accelerator opening detected by the accelerator opening sensor 72 and the acceleration detected by the acceleration sensor 74.

Next, the CPU 14 outputs a control sound and a sound signal according to the accelerator opening and the acceleration in step S216. Specifically, by the function of the output unit 60, the CPU 14 outputs, from the speaker 38, a control sound with a smaller amplitude as the accelerator opening detected by the accelerator opening sensor 72 and the acceleration detected by the acceleration sensor 74 increase. The CPU 14 also outputs the sound signal from the speaker 38. The CPU 48 then transitions to the processing of step S218.

Subsequently, the CPU 14 determines in step S218 whether or not the sound after the phase cancellation is larger than the noise signal. Specifically, the CPU 14 uses the function of the output sound signal acquisition unit 62 to acquire the output sound signal output from the speaker 38 using the error microphone 34. Then, when the output sound signal obtained by the error microphone 34 is larger than the noise signal, that is, when the amplitude of the output sound signal obtained by the error microphone 34 is larger than the amplitude of the noise signal obtained by the first microphone 30, the CPU 14 proceeds to the process of step S220. On the other hand, when the amplitude of the output sound signal acquired by the error microphone 34 is smaller than the amplitude of the noise signal obtained by the first microphone 30, the noise muffling process is ended due to the sound being normally muffed.

The CPU 14 stops the output of the control sound and the sound signal by the output unit 60 in step S220. When the amplitude of the sound signal acquired by the error microphone 34 is larger than the amplitude of the noise signal obtained by the first microphone 30, it means that noise muffling is not being normally performed; therefore, by stopping the output of the control sound and the sound signal, the generation of sound louder than the noise signal is suppressed.

As described above, in the present embodiment, the amplitude of the control sound output by the output unit 60 is reduced as at least one of the accelerator opening and the acceleration increases. As a result, the level of noise silenced by the control sound is reduced. That is, the noise muffling level decreases as at least one of the accelerator opening degree and the acceleration increases, so that it is possible to give a feeling that the vehicle is accelerating during driving. As a result, it is possible to prevent the pleasure of driving the vehicle from being impaired.

Further, in the present embodiment, when the wakefulness or awakening degree or alertness level of the occupant becomes lower than the predetermined value, the amplitude of the control sound output by the output unit 60 is reduced. As a result, the level of noise silenced by the control sound is reduced, and even a passenger with a low awakening degree, such as when falling asleep, can hear the noise signal. As a result, the passenger can be awakened. Other operations are similar to those in the first exemplary embodiment.

Although the noise suppressor and the noise suppressing method according to some embodiments have been described above, it is needless to say that they can be implemented in various modes without departing from the scope of the present disclosure. For example, in the above-described embodiments, the first sound signal acquisition unit 50 is configured to acquire all of road noise, wind noise, and blowing noise as noise signals, but the present disclosure is not limited to this. That is, the first sound signal acquisition unit 50 may be configured to acquire only road noise as a noise signal, or may be configured to acquire only wind noise as a noise signal. In addition to this, a configuration may be used in which periodic noise such as engine noise is acquired as a noise signal.

Further, in the above-described embodiments, the second sound signal acquisition unit 52 is configured to acquire sound signals of both frequencies of voice and siren, but the present disclosure is not limited to this. For example, the second sound signal acquisition unit 52 may be configured to acquire only the voice generated by the occupant, or may be configured to acquire only the siren of the emergency vehicle.

Furthermore, in the above embodiments, the first microphone 30, the second microphone 32, the error microphone 34, and the speaker 38 are provided in each seat of the vehicle, but the present disclosure is not limited to this. For example, the first microphone 30, the second microphone 32, the error microphone 34, and the speaker 38 may be provided only in the driver's seat and the front passenger seat. Further, the first microphone 30, the second microphone 32, the error microphone 34, and the speaker 38 may be provided only in the rear seat. Furthermore, the disclosure is not limited to the vehicle being an automobile, and may be applied to other types of vehicles. For example, it may be applied to trains and airplanes.

Furthermore, in the above embodiments, the prediction unit 56 inputs the noise signal acquired by the first sound signal acquisition unit 50 to the learned model M generated by the learning unit 54, so as to predict the noise signal after the elapse of the predetermined amount of time, but is not limited to this. For example, it may be applied to the vehicle which is not equipped with the prediction unit 56. In this case, the functions of the learning unit 54 and the prediction unit 56 are eliminated from the functional configurations illustrated in FIGS. 2 and 6, and a control sound having the opposite phase to the noise signal acquired at the first sound signal acquisition unit 50 is generated. However, from the viewpoint of effectively muting, it is preferable that the prediction unit 56 predicts the noise signal. Further, as the learned model M of the above embodiments, the LSTM which is a kind of RNN is applied as an example, but other neural networks may be applied.

In the second embodiment, the alertness level determination unit 78 reduces the noise muffling level when the awakening level or alertness level of the occupant is lower than the predetermined value, but the present disclosure is not limited to this. For example, it may be configured that the occupant can turn off a noise suppression function at an arbitrary timing. In this case, by switching the noise suppression to OFF when the passenger in the rear seat is sleeping, the noise muffling level does not have to be lowered. That is, even when the alertness level determination unit 78 determines that the alertness level of the occupant is lower than the predetermined value, the output unit 60 may maintain the noise muffling level without reducing the amplitude of the control sound. Further, the alertness level sensor 76 may be provided only in the driver's seat.

Furthermore, in the second embodiment, the amplitude of the control sound is changed according to both the accelerator opening and the acceleration, but the present disclosure is not limited to this. For example, the amplitude of the control sound may be changed according to only the accelerator opening detected by the accelerator opening sensor 72. In this case, as the accelerator opening detected by the accelerator opening sensor 72 increases, the output unit 60 outputs a control sound with a smaller amplitude, so that a feeling of speeding can be obtained regardless of the acceleration. On the contrary, the amplitude of the control sound may be changed in accordance with only the acceleration detected by the acceleration sensor 74.

Note that any of various types of processors other than the CPU 14 may execute the noise suppressing processing that the CPU 14 executes by reading out software (programs) in the above-described embodiments. Examples of such processors include programmable logic devices (PLD) with circuit configurations that are reconfigurable after manufacture, such as field-programmable gate arrays (FPGA), and dedicated electronic circuits that are processors including circuit configurations custom designed to execute specific processing, such as application specific integrated circuits (ASIC) or the like. Further, the noise suppressing processing may be executed by one of these various types of processors, or may be executed by combining two or more of the same type or different types of processors, for example, plurals FPGAs, or a combination of a CPU and an FPGA, or the like. More specific examples of hardware structures of such processors include electric circuits configured by combining circuit elements such as semiconductor devices.

Moreover, in the above exemplary embodiments, the storage 20 serves to record various data, but there is no limitation thereto. A recording medium such as, for example, a CD (Compact Disk), a DVD (Digital Versatile Disk), a USB (Universal Serial Bus) memory, or the like may be made to be the recording section. In this case, various programs and data are stored in these recording media.

What is claimed is:

1. A noise suppressor for a vehicle, comprising:
a memory; and
a processor coupled to the memory, wherein the processor is configured to:
acquire a noise signal in a vicinity of a head region of an occupant seated in a vehicle seat;
generate a control sound having an opposite phase to the acquired noise signal;
acquire a sound signal having a predetermined frequency that is different from the noise signal;
output, as an output sound signal, the acquired sound signal in combination with the generated control sound;
detect at least one of a vehicle accelerator position or a vehicle acceleration of the vehicle; and
reduce an amplitude of the control sound to be output in response to an increase of the at least one of the detected vehicle accelerator position or the detected vehicle acceleration.

2. The noise suppressor according to claim 1, wherein the sound signal includes at least one of a voice uttered by the occupant or a siren of an emergency vehicle.

3. The noise suppressor according to claim 1, wherein the noise signal includes at least one of road noise, wind noise, or air blowing noise of an air conditioner of the vehicle.

4. The noise suppressor according to claim 1, wherein the processor is configured to:
acquire the output sound signal; and
in response to the acquired output sound signal being larger than the acquired noise signal, stop output of the output sound signal.

5. The noise suppressor according to claim 1, further comprising:
an alertness level sensor configured to detect an alertness level of the occupant,
wherein, in response to the alertness level detected by the alertness level sensor being lower than a predetermined value, the processor is configured to reduce the amplitude of the control sound to be output.

6. The noise suppressor according to claim 1, wherein the processor is configured to:
predict a noise signal after an elapse of a predetermined amount of time by inputting the acquired noise signal into a learned model generated by machine learning from learning data of the noise signal obtained during traveling; and
generate the control sound having an opposite phase to the predicted noise signal.

7. A noise suppressing method for a vehicle, the method comprising:
acquiring, by a processor, a noise signal in a vicinity of a head region of an occupant seated in a vehicle seat;
generating, by the processor, a control sound having an opposite phase to the acquired noise signal;
acquiring, by the processor, a sound signal having a predetermined frequency that is different from the noise signal;
outputting, by the processor, the acquired sound signal in combination with the generated control sound;
detecting at least one of a vehicle accelerator position or a vehicle acceleration of the vehicle; and reducing an amplitude of the control sound to be output in response to an increase of the at least one of the detected vehicle accelerator position or the detected vehicle acceleration.

8. A noise suppressor for a vehicle, wherein the vehicle has a plurality of seats, a plurality of first microphones, a plurality of second microphones, and a plurality of speakers, each vehicle seat among the plurality of vehicle seats has, in a vicinity of the vehicle seat, a respective first microphone among the plurality of first microphones, a respective second microphone among the plurality of second microphones, and a respective speaker among the plurality of speakers, the noise suppressor comprises:

a memory; and a processor coupled to the memory, and the processor is configured to, for each vehicle seat among the plurality of vehicle seats:

acquire, from the respective first microphone, a noise signal in a vicinity of a head region of an occupant seated in the vehicle seat;

generate a control sound having an opposite phase to the acquired noise signal;

acquire, from the respective second microphone, a sound signal having a predetermined frequency that is different from the noise signal;

from the respective speaker, output the control sound corresponding to the vehicle seat, and output the sound signal acquired from the second microphone of at least one other vehicle seat among the plurality of vehicle seats;

detect at least one of a vehicle accelerator position or a vehicle acceleration of the vehicle; and reduce an amplitude of the control sound to be output in response to an increase of the at least one of the detected vehicle accelerator position or the detected vehicle acceleration.

* * * * *